US005967231A

United States Patent [19]

Laurel et al.

[11] Patent Number: 5,967,231

[45] Date of Patent: Oct. 19, 1999

[54] PLUG RELEASE INDICATION METHOD

[75] Inventors: David F. Laurel; Charles A. Butterfield, Jr., both of Duncan; Stephen E. Tilghman, Marlow, all of Okla.

[73] Assignee: Halliburton Energy Services, Inc., Duncan, Okla.

[21] Appl. No.: 08/962,314

[22] Filed: Oct. 31, 1997

[51] Int. Cl.[6] ..... E21B 47/00

[52] U.S. Cl. ..... 166/250.04; 166/291

[58] Field of Search ..... 166/250.01, 250.04, 166/291, 253.1, 53, 70

[56] References Cited

U.S. PATENT DOCUMENTS

| | | | |
|---|---|---|---|
| 2,201,311 | 5/1940 | Halliburton | 181/0.5 |
| 3,863,716 | 2/1975 | Streich | 166/70 |
| 4,206,810 | 6/1980 | Blackman | 166/336 |
| 4,290,482 | 9/1981 | Brisco | 166/70 |
| 4,468,967 | 9/1984 | Carter, Jr. | 73/661 |
| 4,574,882 | 3/1986 | Szarka | 166/75.1 |
| 4,638,278 | 1/1987 | Bullock | 335/207 |
| 4,782,894 | 11/1988 | LaFleur | 166/70 |
| 4,857,851 | 8/1989 | Anderson et al. | 324/326 |
| 4,928,520 | 5/1990 | Barrington | 73/151 |
| 5,040,603 | 8/1991 | Baldridge | 166/250.04 X |
| 5,236,035 | 8/1993 | Brisco et al. | 166/70 |
| 5,252,918 | 10/1993 | Vanberg et al. | 166/250.04 X |
| 5,293,933 | 3/1994 | Brisco | 166/70 |
| 5,323,856 | 6/1994 | Davis et al. | 166/253 |
| 5,413,172 | 5/1995 | Laurel | 166/153 |
| 5,435,390 | 7/1995 | Baugh et al. | 166/285 |
| 5,443,122 | 8/1995 | Brisco | 166/285 |
| 5,553,667 | 9/1996 | Budde et al. | 166/70 |
| 5,787,979 | 8/1998 | Giroux et al. | 166/177.4 |
| 5,813,457 | 9/1998 | Giroux et al. | 166/153 |
| 5,833,002 | 11/1998 | Holcombe | 166/291 |

FOREIGN PATENT DOCUMENTS 2 314 361 12/1997 United Kingdom ..... E21B 33/05

OTHER PUBLICATIONS

LaFleur Petroleum Services publication entitled "Fasdrop—Safety Remote Cementing Head—Operation and Maintenance Manual," believed to be published prior to Oct. 1, 1996.

LaFleur Petroleum Services publication entitled "Now . . . a safe, sure and proven cementing head that permits positive plug drop with continuous cement flow," believed to be published prior to Oct. 1, 1996.

*Primary Examiner*—Roger Schoeppel

*Attorney, Agent, or Firm*—Craig W. Roddy; E. Harrison Gilbert, III

[57] ABSTRACT

A method of indicating the release of a plug, such as a cementing plug for an oil or gas well, includes releasing a plug from a retained position in a tube system, and in response to releasing the plug, opening an electrical circuit to which the plug was connected in the retained position. The method also includes generating, in response to opening the electrical circuit, a plug release indicator signal. The indicator signal can be generated in response to, for example, a low frequency electromagnetic signal.

18 Claims, 6 Drawing Sheets

PLUG RELEASE INDICATION METHOD

BACKGROUND OF THE INVENTION

This invention relates to methods of indicating the release of one or more plugs in a pipe or tube system of an oil or gas well. Such a system includes a drill, completion or production string (any such system is referred to in this specification and the claims simply as "tube system" or specifically "plug release tube system"). Particular utility is with regard to plugs used in a cementing operation in an oil or gas well, especially a subsea well.

Cement is used in oil or gas wells for various purposes. One purpose is to secure a tubular string (e.g., a casing or a liner) in the well bore. This is typically done by pumping cement down the tubular string and forcing it back up an annular space between the outside of the string and the inside of the well bore or of a larger diameter string in which the first-mentioned string is disposed.

To separate the cement slurry from drilling mud typically in the well when the cementing operation begins, a bottom cementing plug is placed in line and pumped down the string by the force of the following cement slurry. This bottom plug serves to minimize contamination of the cement as it is pumped down the tubular string. The bottom plug also wipes any accumulated mud film from the inner diameter of the string and pushes it ahead.

To separate a following displacing fluid used to push the cement slurry out the tubular string and up the annular space, a top cementing plug is placed in line and pushed down the string by the displacing fluid. This top plug follows the cement and wipes any accumulated cement film from the inner diameter of the tubular string. It also prevents or reduces any contamination of the cement by the displacing fluid.

In wells drilled on land, surface-mounted plug containers are used in many cementing jobs to release the cementing plugs at the proper time. Normal job operations will have the bottom cementing plug loaded into the plug container prior to pumping cement. The top cementing plug will typically be loaded after the bottom plug is released. If well conditions dictate, two plug containers or a double plug container may be used to release both cementing plugs when desired without opening the plug container.

Subsea (ocean floor) completions are different from the aforementioned land-based cementing operations in that the cementing plugs used for separating the fluids are preferably located in the tubular string below the ocean floor. This is preferred because these plugs have a diameter large enough to wipe the inner diameter of the tubular string extending below the ocean floor, and this tubular string (and thus each plug) typically has a larger diameter than need be used for connecting this string with the equipment on the rig at the ocean's surface. Thus, the cement slurry is preferably pumped from the surface through a string of drill pipe smaller than the string being cemented, which smaller string extends between the surface rig and the downhole string to be cemented. This creates the need for a second type of plug container that houses elements, which may broadly be called "plugs" also, which are of smaller diameter to permit these plugs to pass through the narrower connecting string and into the downhole cementing plugs. A system using this technique is the Halliburton Energy Services'sub-surface release system ("SSR Cementing Plug Method"). This system provides a means of wiping different pipe sizes; therefore, smaller diameter drill pipe can be used as described instead of the larger diameter casing that otherwise would be run between the rig floor and the ocean floor.

This prior art subsea release system will be briefly explained with reference to FIGS. 1–3. These drawings schematically illustrate the sequence of operation.

FIG. 1 shows bottom and top cementing plugs 2, 4, respectively, installed at the top of casing 6 (i.e., the tubular string in the subsea well bore) prior to beginning the actual cementing operation. A set of releasing pins attaches the bottom cementing plug 2 to the top cementing plug 4.

A weighted plastic or bronze ball 8 housed in a surface plug container 10 is dropped through connecting drill pipe 12 ahead of the cement slurry. The drill pipe 12 connects the casing 6 in the subsea well bore and the plug container 10 at the surface. The ball 8 passes through a wider axial channel of the top plug 4 and lands on a seat of the bottom plug 2. A differential pressure applied through the drill pipe 12 from the surface separates the thus sealed bottom plug 2 from the top plug 4.

FIG. 2 illustrates how the bottom plug 2 has been discharged from the top plug 4 and seated on a float collar 14 (or float shoe). At this point, a small increase in pressure exposes port holes in the plug 2 so that the cement slurry can be pumped around the bottom plug releasing ball 8.

A collet releasing mechanism holds the top plug 4 in place and permits circulation through the top cementing plug 4 at normal displacement rates prior to release of the top plug 4. To release the top cementing plug 4, a top releasing plug 16 from the surface plug container 10 is pumped down the drill pipe 12 behind the slurry and into the top cementing plug 4 where it latches and seals therewith. An applied pressure shears releasing pins to enable the top plug 4 to move down the casing 6.

As shown in FIG. 3, the top cementing plug 4 lands on the bottom cementing plug 2 to shut off flow in conventional manner.

It is desirable to know that a plug used in the operation described above has properly released. If the ball 8 for the bottom plug 2 is released and allowed to free fall, a pressure change sensed at the surface can be used to indicate seating of the ball and then to indicate release upon pumping the cement or other fluid into the well after the free fall has ended. With offshore drilling moving into deeper waters, however, it is undesirable to allow the weighted ball for the bottom plug release to free fall to the ball seat. Wells drilled in waters over 6,000 feet deep, for example, would require approximately thirty minutes for the weighted ball to reach the ball seat. To avoid this delay, the cement slurry is pumped immediately after the weighted ball is released, but this practice usually does not show a pressure indication that the bottom plug has released. Thus, to allow for the expedited delivery of the cement by pumping it immediately behind the ball 8 and yet obtain an indication of plug release in the well, there is the need for a method to indicate plug release without relying on a pressure indication. This need also exists with regard to surface mounted plugs. There is also the need for the indication produced by any such method to be readily communicated.

SUMMARY OF THE INVENTION

The present invention meets the aforementioned needs by providing a novel and improved method of indicating the release of a plug of the type referred to above or otherwise used in a tube system of the type defined above. No pressure indication is needed for the present invention to indicate release. Rather, the present invention uses positive make/break connections with an electrical circuit to ensure reliable operation in indicating the release of one or more plugs. One particular type of indication uses a low frequency electromagnetic signal.

The method of indicating the release of a plug comprises releasing a plug from a retained position in a tube system, and in response to releasing the plug, opening an electrical circuit to which the plug was connected in the retained position. The method further comprises generating, in response to opening the electrical circuit, a plug release indicator signal.

The method of the present invention can also be defined as comprising: releasing a first plug from a first retained position in a well; in response to releasing the first plug, disconnecting the first plug from a first electrical circuit to which the first plug was connected in the well; generating, in response to disconnecting the first plug from the first electrical circuit, a first plug release indicator signal remote from the well; releasing a second plug from a second retained position in the well; in response to releasing the second plug, disconnecting the second plug from a second electrical circuit to which the second plug was connected in the well; and generating, in response to disconnecting the second plug from the second electrical circuit, a second plug release indicator signal remote from the well. Generating a first plug release indicator signal can include energizing a first signaling device at a surface above the well in response to disconnecting the first plug from the first electrical circuit, and generating a second plug release indicator signal can include energizing a second signaling device at the surface in response to disconnecting the second plug from the second electrical circuit.

The method of the present invention can still further be defined as comprising steps of transmitting a low frequency electromagnetic signal from within a plug release tube system at an oil or gas well in response to the occurrence of an event in the plug release tube system; and actuating a signaling device outside the plug release tube system, but still at the oil or gas well, in response to the electromagnetic signal.

Therefore, from the foregoing, it is a general object of the present invention to provide a novel and improved method of indicating the release of a plug. Other and further objects, features and advantages of the present invention will be readily apparent to those skilled in the art when the following description of the preferred embodiments is read in conjunction with the accompanying drawings.

BRIEF DESCRIPTION OF THE DRAWINGS

FIG. 5 is a schematic illustration of a subsea release cementing head connected to drill pipe at the surface above the well in which the plug assembly of FIG. 4 is located.

FIG. 6 is a schematic illustration showing a bottom plug released from the assembly of FIG. 4 and disconnected from an electrical circuit of which it was a part.

FIG. 9 is a schematic illustration showing the illuminated light as the surface signal indicating that the bottom plug has released, and also showing an illuminated light as the surface signal indicating that the top plug has released, which illumination of this light occurs in response to the top plug disconnecting from its electrical circuit.

FIG. 11 is a schematic circuit and block diagram illustrating a particular implementation of one of the signaling circuits and one of the sensors of FIG. 10.

DETAILED DESCRIPTION OF THE INVENTION

Figure 1:
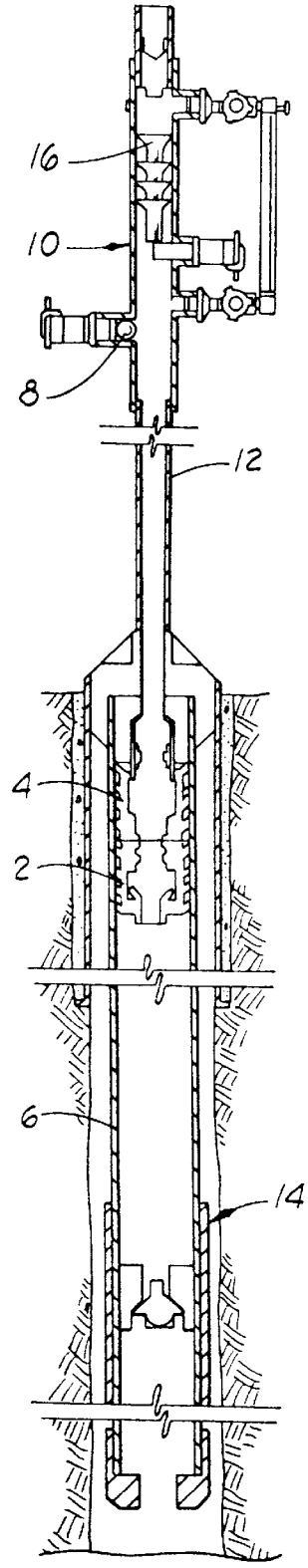
FIG. 1 PRIOR ART
FIG. 1 is a schematic illustration of a prior art cementing plug system with which the preferred embodiment of the present invention can be used.
Figure 2:
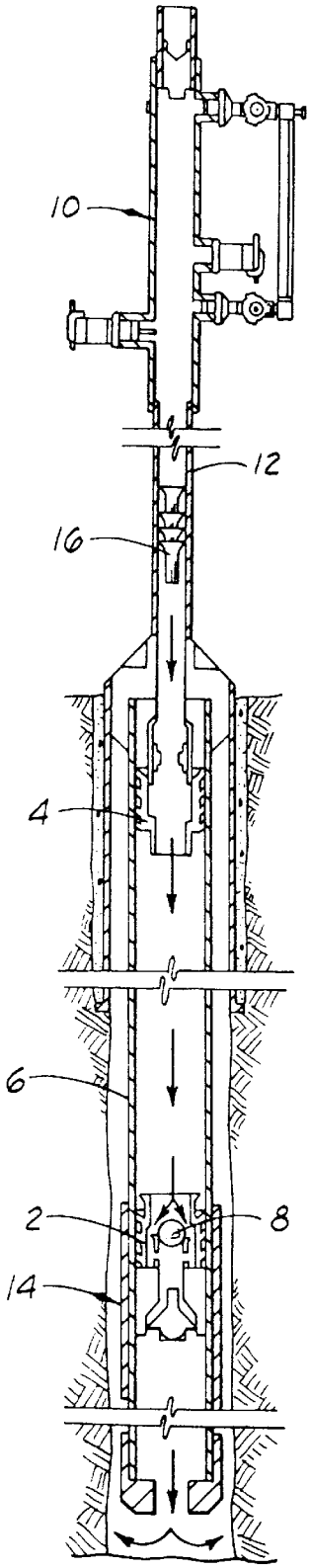
FIG. 2 PRIOR ART
FIG. 2 is a schematic illustration of the prior art cementing plug system of FIG. 1 showing one phase of operation.
Figure 3:
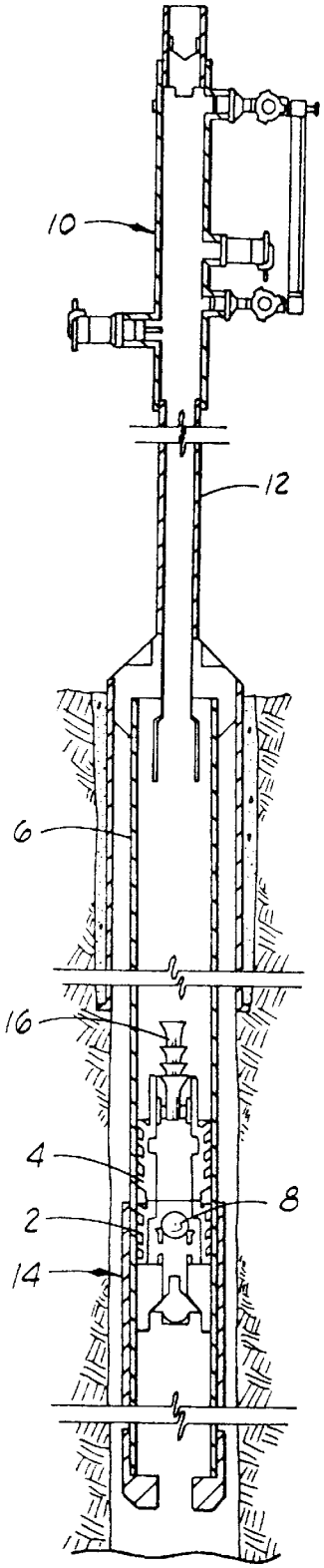
FIG. 3 PRIOR ART
FIG. 3 is a schematic illustration of the prior art cementing plug system of FIG. 1 showing another phase of operation.
Figure 3:
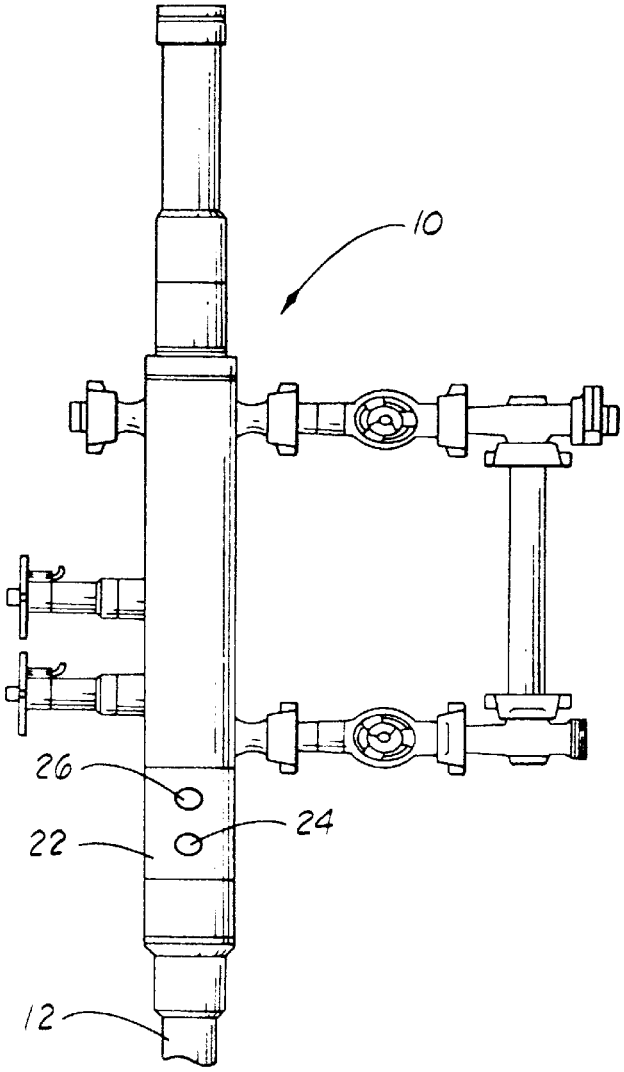
Figure 4:
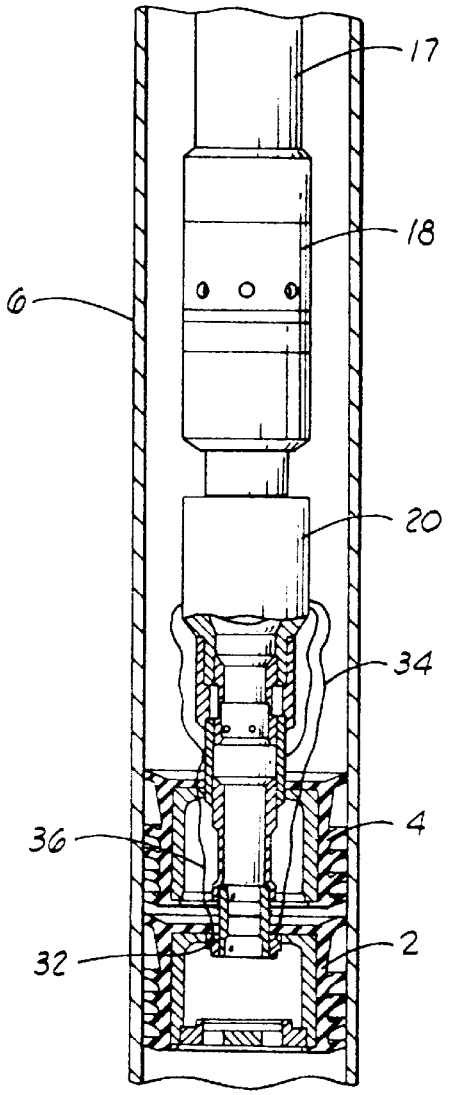
FIG. 4 is a schematic illustration of a subsea release plug assembly connected for use in the method of the present invention.

Referring to FIGS. 4 and 5, parts of the environment shown in FIGS. 1–3 are illustrated with additional features for implementing the method of the present invention. Part of the casing 6 is shown in FIG. 4, and the bottom plug 2 and the top plug 4 are shown as a plug assembly with each plug retained in the casing 6 at a respective location by being suspended from a support string 17 formed as an extension of, or hung from or below, or disposed through the string 12 illustrated in FIGS. 1–3 and 5. A conventional subsea release swivel/equalizer assembly 18 is shown connected near the end of the support string 17 above the plugs 2, 4.

Also shown in FIG. 4 is an electronic signal generator 20 placed between the swivel/equalizer assembly 18 and the subsea release plug assembly which includes the plugs 2, 4. The electronic signal generator 20 is any suitable apparatus capable of initiating the plug release signals provided outside the well and also capable of being hard wired by electrical conductors to the plugs 2, 4 as further described below. For the two-plug implementation disclosed in the drawings, the signal generator 20 sends distinctive signals to the surface above the well where a signal receiver 22 is located between the subsea release cementing head 10 and the drill pipe 12 as shown in FIG. 5. The signal receiver 22 is any suitable apparatus for sensing the signals communicated from the signal generator 20. The signal receiver 22 shown in FIG. 5 includes two lamps 24, 26 that are illuminated to signal detected release of the bottom plug 2 and the top plug 4, respectively.

Figure 7:
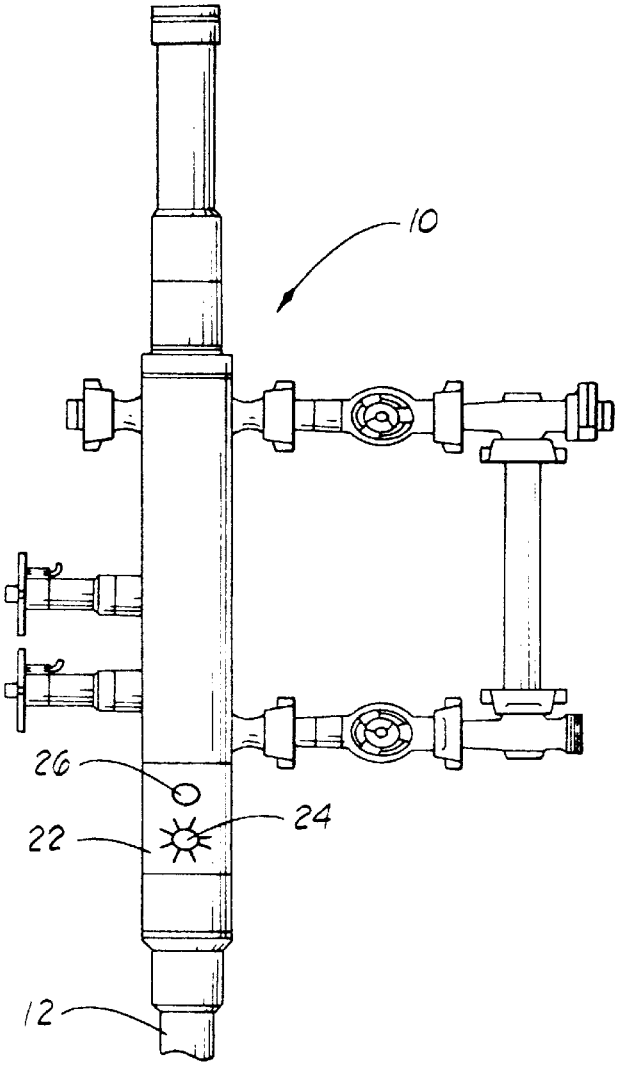
FIG. 7 is a schematic illustration showing an illuminated light as the surface signal indicating that the bottom plug has released, which illumination of the light occurs in response to the bottom plug disconnecting from its electrical circuit.

To release the bottom plug 2, the ball 8 is released from the cementing head 10 in conventional manner with the cementing operation commencing immediately upon such release. As the ball 8 seats in the ball seat of the bottom plug 2 at the rate at which the cement is being displaced by pumping, the bottom plug 2 is released from its previously retained location in the well due to the force of the pumped column of cement. The released plug 2 is displaced down the casing as depicted in FIG. 6. In response to this release of the plug 2, electrical contacts or connections of the plug 2 with an electrical circuit in the signal generator 20 are disconnected. This opens the electrical circuit of the signal generator 20. In response to this disruption of the signal flow in the circuit of the signal generator 20, the lamp 24 of the signal receiver 22 at the surface is illuminated as depicted in FIG. 7. In the illustrated embodiment, the disconnecting of the bottom plug 2 and the consequent opening of the electrical circuit of the signal generator 20 occur concurrently with release of the bottom plug 2 from its mechanical connection that previously retained the bottom plug 2 in its initial suspended position in the casing 6.

Figure 8:
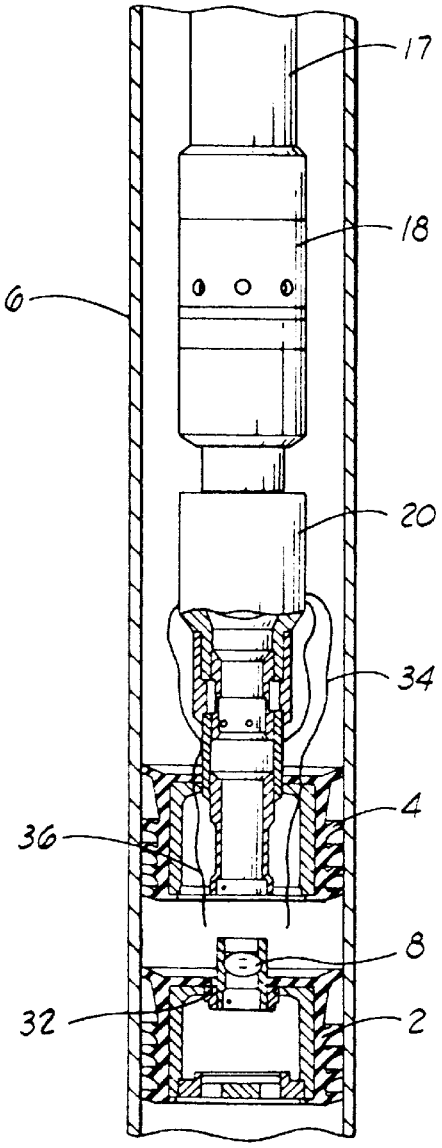
FIG. 8 is a schematic illustration showing a top plug released from the assembly of FIG. 4 and disconnected from an electrical circuit of which it was a part.
Figure 3:
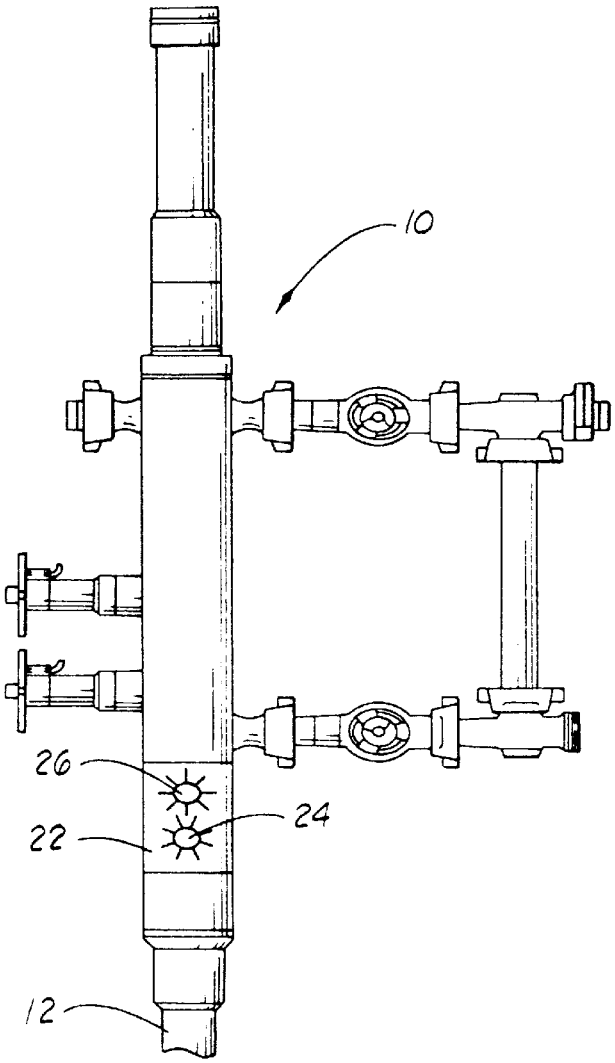
Figure 8:
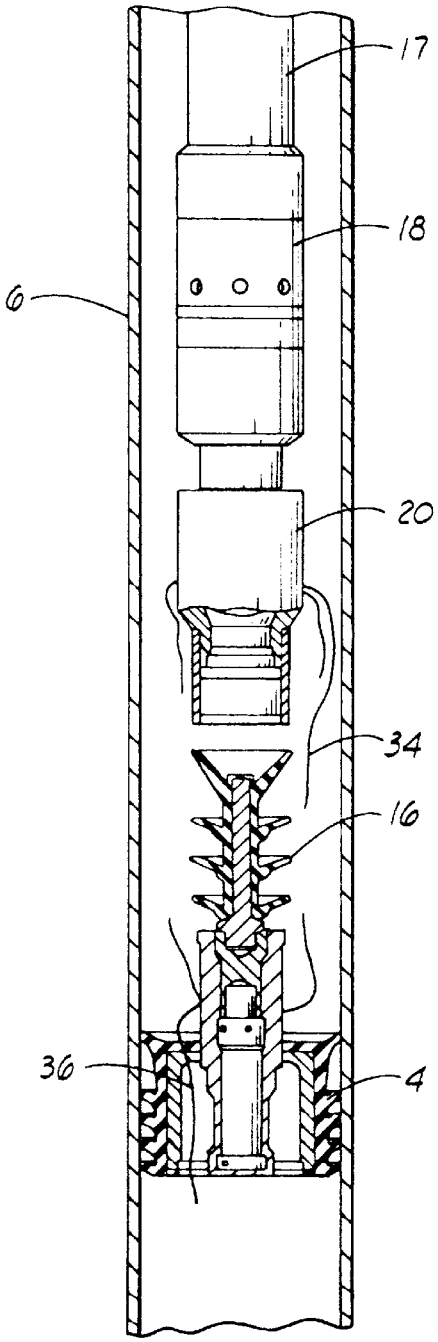

The foregoing operations can be duplicated for the release of the top plug 4; however, preferably a different or distinctive signal is communicated from the signal generator 20 to the signal receiver 22 so that the receiver 22 can readily differentiate between release of the bottom plug and release of the top plug. Release of the top plug 4 from its initial suspended position, and the concurrent severing of its electrical connection with the respective circuit of the signal generator 20, is illustrated in FIG. 8. This typically is obtained by pumping the top releasing plug 16 down the drill pipe 12 in conventional manner. In response to the electrical connection of the circuit associated with the top plug 4 being severed, the signal receiver 22 at the surface illuminates the lamp 26 as shown in FIG. 9.

The foregoing system can also be adapted (such as by incorporating a timer or clock and a memory triggered to record a time at which each signal is received from the signal generator 20) to record when the releases occurred and the sequence in which the plug releases occurred.

Figure 10:
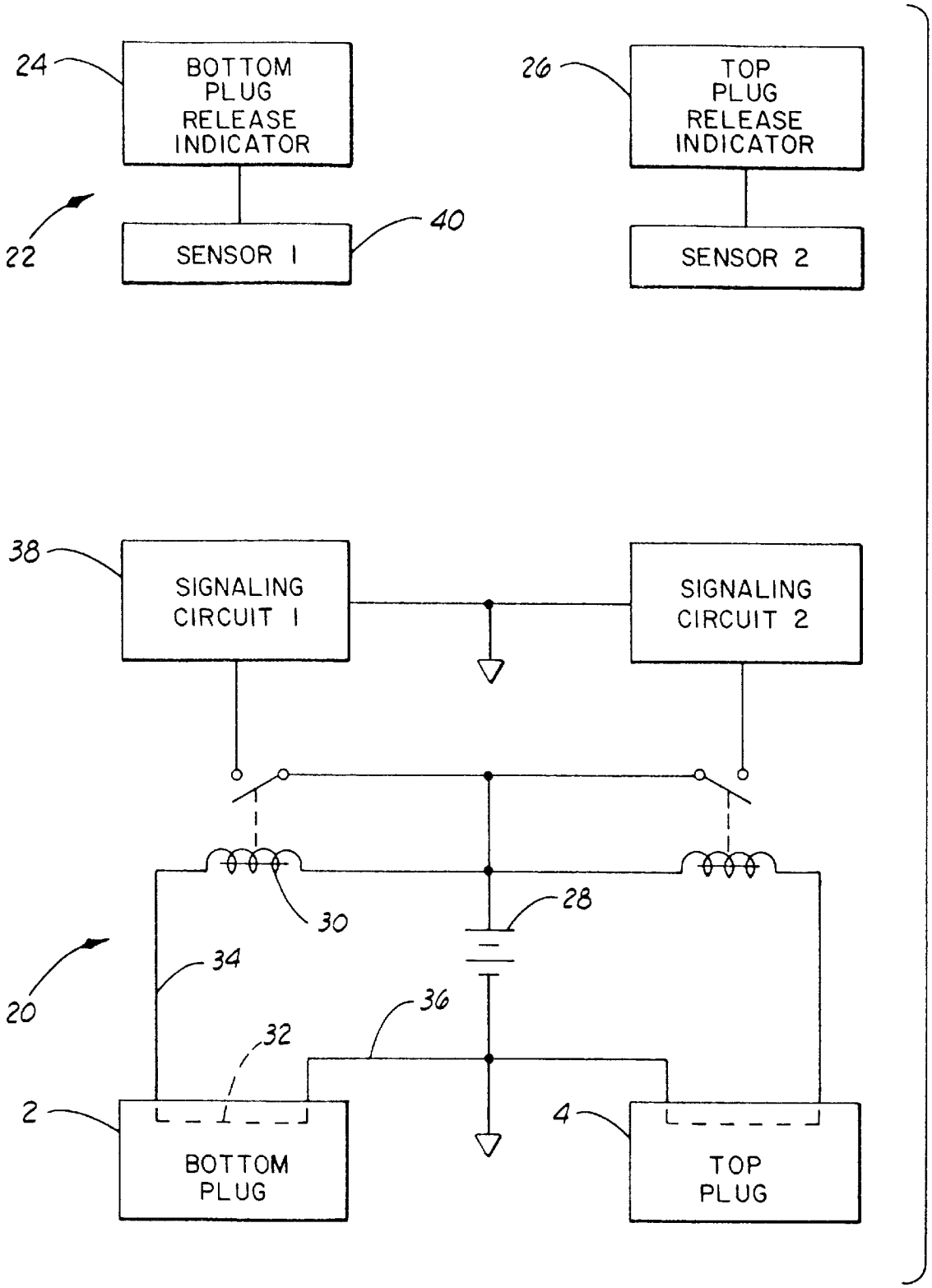
FIG. 10 is a schematic circuit and block diagram illustrating an implementation of a signal generator and a signal receiver of the system of FIGS. 4–9.
Figure 7:
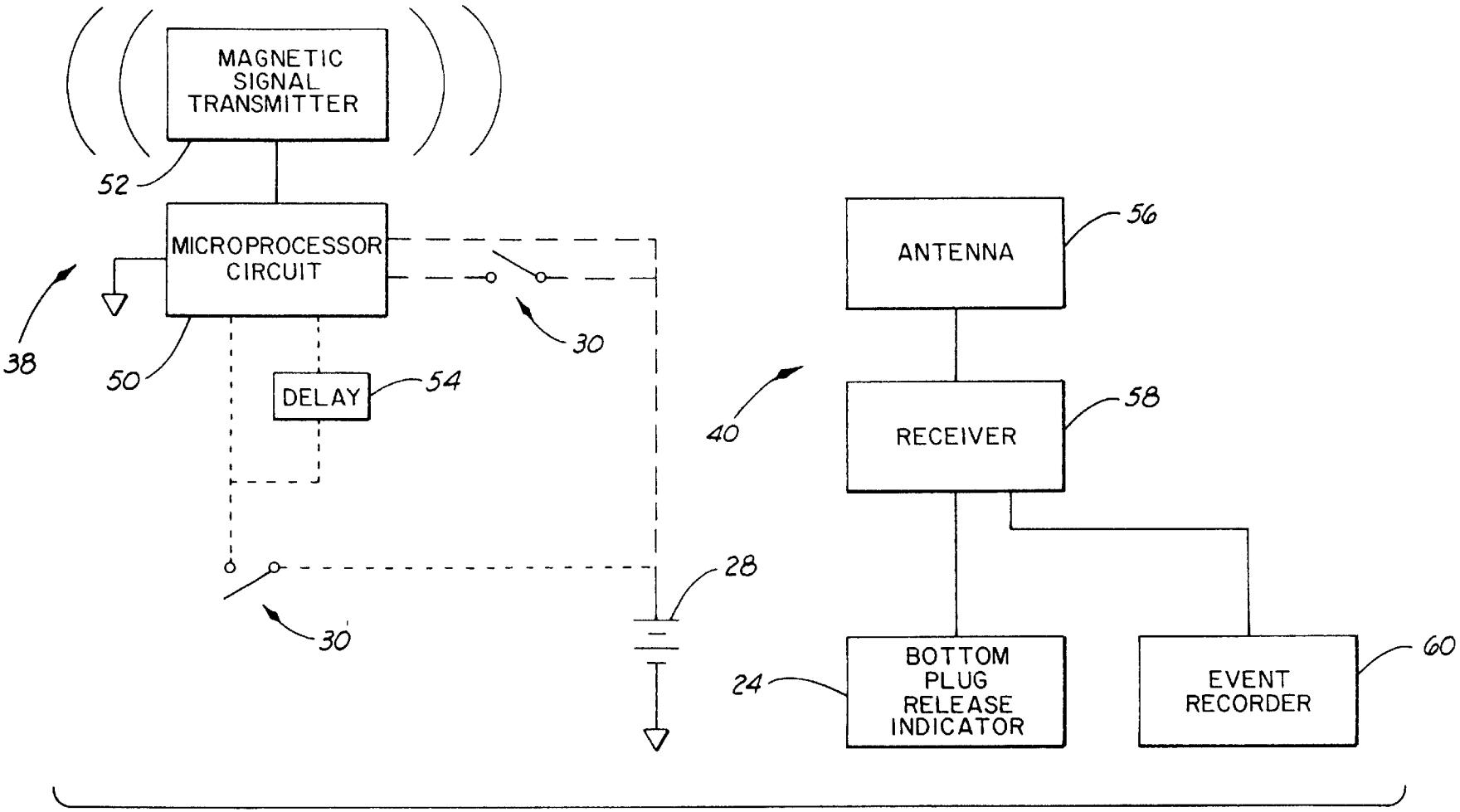

Referring to FIG. 10, an example of an implementation of the signal generator 20 and the signal receiver 22 will be described.

The signal generator of the simplified illustration of FIG. 10 includes a respective electrical circuit for each of the plugs 2, 4. One circuit includes a battery 28 which energizes an electrical solenoid switch 30 connected by suitable electrical conductors to the battery 28. This circuit is completed, or closed, when the bottom plug 2 is connected such that an electrical conductor 32 disposed in the bottom plug 2 is connected to conductors 34, 36 of the electrical circuit. The conductors 34, 36 are illustrated as wires in FIGS. 4 and 6; however, the conductors 34, 36 can be other types of conductive members which may be embedded in or housed within, or otherwise associated with, the bottom sub of the support string 17 of which the signal generator 20 and the plug assembly are parts. Likewise, the conductor 32 can be any suitable connection between the conductors 34, 36.

Connection of the conductor 32 to the conductors 34, 36 can be by any suitable means that breaks, severs or otherwise disconnects in response to the release of the plug 2 from its mechanical retention in the plug assembly. This can include soldering or otherwise connecting frangible wires directly to the member 32 of the bottom plug 2. Another possible embodiment is to have a plug and jack configuration between each of the conductors 34, 36 and the respective ends of the conductor member 32. Other implementations can be used as well (e.g., the conductors themselves can break as illustrated in FIG. 8 for the released top plug 4).

This circuit of the signal generator 20 also includes a signaling circuit 38 connected to one terminal of the solenoid switch 30 and to the negative terminal of the battery 28 as illustrated in FIG. 10. When the bottom plug 2 releases, thereby disconnecting the electrical conductor 32 from the conductors 34 and 36, the solenoid 30 is de-energized whereby the switch member closes to connect the positive terminal of the battery 28 to the signaling circuit 38. This causes the signaling circuit 38 to send a suitable signal that can be transmitted up the well to be received by the signal receiver 22. The signaling circuit 38 can be any suitable means for achieving such signaling. This can include acoustic signaling, pressure pulse signaling, electrical signaling, electromagnetic signaling or other known techniques for transmitting signals from down in a well to the surface.

The signal generator 20 includes another electrical circuit of the same type just described. This is illustrated as sharing the battery 28 but otherwise has its own components as shown in FIG. 10. This circuit functions the same but in response to release of the top plug 4 as apparent from the drawing.

Still referring to FIG. 10, the illustrated signal receiver 22 includes respective sensor and plug release indicators. A sensor 40 responds to the signal from the signaling circuit 38 and the other sensor illustrated in FIG. 10 responds to the signaling circuit associated with the top plug 4. The bottom plug release indicator in FIG. 10 is the lamp 24 shown in FIGS. 5, 7 and 9. The top plug release indicator is the lamp 26 shown in the same drawings. Other types of signaling or indicator devices can be used. The sensor 40 and the matching sensor for the circuit associated with the top plug 4 can be of any suitable types adapted to sense the respective type of signal sent from the signal generator 20. For example, each sensor can respond to the respective signal and in response close an energizing circuit for the respective indicator 24, 26.

Although the components of FIG. 10 can be implemented by any suitable equipment as referred to above, a particular implementation uses equipment that provides magnetic (specifically, electromagnetic) signaling. In particular, this implementation uses a low frequency electromagnetic signal to transmit the event information from inside the tube system to outside the tube system (e.g., across the steel or other composition of the pipe or tubing in an oil or gas well) to an antenna system external to the typically pressurized environment within the tube system. Such an implementation is illustrated in FIG. 11.

In the implementation of FIG. 11, the signaling circuit 38 includes a microprocessor circuit 50 and a magnetic signal transmitter 52 (which preferably generates the signal electromagnetically and thus the signal transmitter is more specifically an electromagnetic signal transmitter in the preferred embodiment). These are of conventional types such as used with pipeline pigs but adapted for use within the particular environment in which they are used in a particular application of the present invention.

The microprocessor circuit 50 is located within the tube system, typically where the plug is initially retained. This is a battery powered microcontroller or other microprocessor based circuit that receives the physical indication of the specified event to be monitored. Two examples of how this indication is received are illustrated in FIG. 11.

One indication is provided by the circuit indicated with the shorter dashed lines. When the switch of the solenoid 30 closes, it energizes the microprocessor circuit 50 from the battery 28, and this same action provides an interrupt signal to the microprocessor through a delay circuit 54. In response to energization and the interrupt, the microprocessor circuit 50 sends one or more control signals to the signal transmitter 52 which emits the low frequency electromagnetic signal of this implementation. In a particular preferred implementation, low frequency means less than twenty-five hertz.

The other event indicating technique is shown by the longer dashed lines in FIG. 11. This shows that the microprocessor circuit of this implementation is continuously energized by the battery 28. When the event is detected by the closure of the switch of the solenoid 30, this provides a signal to an interrupt input of the microprocessor circuit 50 which thereafter functions the same as described above in controlling the signal transmitter 52.

In this latter implementation with the microprocessor circuit 50 continuously energized, the microprocessor can be programmed to continuously or repetitiously activate the signal transmitter 52 to send a low frequency electromagnetic signal that is different from the signal sent when the event is detected and indicated by the closure of the switch of the solenoid 30. This continuous or repetitious signal has its own specific code or pattern to allow the receiver of the sensor 40 to monitor whether the microprocessor circuit 50 and transmitter 52 are properly operating, as indicated by the continuous or repetitious signal, as opposed to when an event is detected, as indicated by the different signal transmitted in response to closure of the switch of the solenoid 30.

The sensor 40 of the implementation of FIG. 11 includes an antenna 56 located outside the tube system. The antenna 56 is connected to a receiver 58 that decodes received signals and converts the signals to a form that allows an operator to confirm the occurrence of the event, such as by illumination of the bottom plug release indicator 24. The receiver 58 can also be programmed or constructed to transmit a signal or otherwise actuate an event recorder 60 (e.g., a solid state memory) for recording and maintaining a log of events. The communication between the receiver 58 and the event recorder 60 can be localized, such as hardwired circuitry between receiver 58 and a memory implementing the event recorder 60, or remotely, such as via a cable or radio frequency communication to a physically spaced event recorder 60.

The implementation of FIG. 11 has particular application in situations where a minimal (including no) amount of modification to the tube system or external equipment can be made in order to provide communication of an event or of tool functioning information from a pressure isolated environment to a safe environment outside the pressure environment. In the particular application of a tube system made of steel, such as in an oil or gas well, the steel attenuates radio frequency signals so that the low frequency electromagnetic signals referred to above are preferred. Such low frequency signaling can be applied to surface equipment as well as subsea equipment. Such low frequency signaling can also be advantageous relative to pressure signaling which may be difficult to distinguish if the pressure cannot be maintained for a long enough duration or if it cannot be differentiated from pipe pressure spikes. Low frequency electromagnetic signaling can also be advantageous relative to acoustic signaling through a fluid medium.

One shortcoming of a low frequency magnetic signal is that it may have a short range; however, specific ranges depend on coil design and power applied to the coil of a transmitter system.

From the foregoing, it is apparent that the preferred embodiment of the present invention operates by, after initially connecting an electrically conductive member of each downhole plug into a respective electrical circuit, disconnecting such connections in response to releasing the respective plug in its conventional manner during a cementing operation. This provides a highly reliable technique for accurately indicating the release of the plug, which can improve the quality of the cementing operation.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A method of indicating the release of a plug, comprising:

releasing a plug from a retained position in a tube system; and in response to releasing the plug, opening an electrical circuit to which the plug was connected in the retained position.

2. A method as defined in claim 1, further comprising generating, in response to opening the electrical circuit, a plug release indicator signal.

3. A method as defined in claim 2, wherein generating a plug release indicator signal includes:

communicating a signal from within a well containing at least part of the tube system to a surface above the well in response to opening the electrical circuit; and energizing a signaling device at the surface in response to the communicated signal.

4. A method as defined in claim 3, wherein communicating a signal includes transmitting a low frequency electromagnetic signal from within the tube system.

5. A method as defined in claim 2, wherein generating a plug release indicator signal includes:

transmitting a low frequency electromagnetic signal in response to opening the electrical circuit; and energizing a signaling device in response to the electromagnetic signal.

6. A method of indicating the release of a plug, comprising:

releasing a plug from a retained position in a tube system; and concurrently with releasing the plug, disconnecting the plug from electrical connection with an electrical release signal initiation circuit.

7. A method as defined in claim 6, further comprising generating, in response to disconnecting the plug from the circuit, a plug release indicator signal outside the tube system.

8. A method as defined in claim 7, wherein generating a plug release indicator signal includes:

communicating a signal from within a well containing at least part of the tube system to a surface above the well in response to disconnecting the plug from the circuit; and energizing a signaling device at the surface in response to the communicated signal.

9. A method as defined in claim 8, wherein communicating a signal includes transmitting a low frequency electromagnetic signal from within the tube system.

10. A method as defined in claim 7, wherein generating a plug release indicator signal includes:

transmitting a low frequency electromagnetic signal in response to disconnecting the plug from the circuit; and energizing a signaling device in response to the electromagnetic signal.

11. A method of indicating the release of plugs in a well, comprising:

releasing a first plug from a first retained position in a well;

in response to releasing the first plug, disconnecting the first plug from a first electrical circuit to which the first plug was connected in the well;

generating, in response to disconnecting the first plug from the first electrical circuit, a first plug release indicator signal remote from the well;

releasing a second plug from a second retained position in the well;

in response to releasing the second plug, disconnecting the second plug from a second electrical circuit to which the second plug was connected in the well; and generating, in response to disconnecting the second plug from the second electrical circuit, a second plug release indicator signal remote from the well.

12. A method as defined in claim 11, wherein:

generating a first plug release indicator signal includes energizing a first signaling device at a surface above the well in response to disconnecting the first plug from the first electrical circuit; and generating a second plug release indicator signal includes energizing a second signaling device at the surface in response to disconnecting the second plug from the second electrical circuit.

13. A method of indicating the release of a plug, comprising steps of:

(a) transmitting a low frequency electromagnetic signal from within a plug release tube system at an oil or gas well in response to the occurrence of an event in the plug release tube system; and (b) actuating a signaling device outside the plug release tube system, but still at the oil or gas well, in response to the electromagnetic signal.

14. A method as defined in claim 13, further comprising transmitting, at times different from the transmitting of step (a), a low frequency electromagnetic signal different from the electromagnetic signal of step (a) as an indication of the operability of transmitter equipment disposed in the plug release tube system and used for performing step (a).

15. A method as defined in claim 14, wherein step (b) includes receiving the electromagnetic signal of step (a) with an antenna external to the plug release tube system and generating a visual display in response.

16. A method as defined in claim 15, further comprising transmitting, in response to receiving the electromagnetic signal of step (a) with an antenna external to the tube system, a control signal to record the occurrence of the event.

17. A method as defined in claim 13, wherein step (b) includes receiving the electromagnetic signal of step (a) with an antenna external to the plug release tube system and generating a visual display in response.

18. A method as defined in claim 13, further comprising recording the occurrence of the event.

* * * * *